US005136738A

United States Patent [19]

Denson

[11] Patent Number: 5,136,738

[45] Date of Patent: Aug. 11, 1992

[54] PICNIC BLANKET AND STORAGE POUCH

[76] Inventor: Geneva Denson, 656 Vernon Ave., SE., Atlanta, Ga. 30316

[21] Appl. No.: 514,601

[22] Filed: Apr. 26, 1990

[51] Int. Cl.[5] ..... A47G 9/06

[52] U.S. Cl. ..... 5/417; 5/420; 190/2

[58] Field of Search ..... 5/417–420; 190/2, 1

[56] References Cited

U.S. PATENT DOCUMENTS

| | | | |
|---|---|---|---|
| 2,034,369 | 3/1936 | Bayer | 5/419 |
| 2,038,335 | 4/1936 | Aronow | 5/419 |
| 3,477,552 | 11/1969 | Goldman | 5/420 |
| 3,774,249 | 11/1973 | Ybarra et al. | 5/419 |
| 4.195,378 | 4/1980 | Parker | 5/419 |
| 4,197,891 | 4/1980 | Comollo | 5/417 |
| 4,370,767 | 2/1983 | Fraser | 5/419 |
| 4,375,111 | 3/1983 | Hall | 5/420 |
| 4,703,528 | 11/1987 | Rolle | 5/417 |

FOREIGN PATENT DOCUMENTS

| | | | |
|---|---|---|---|
| 819449 | 10/1951 | Fed. Rep. of Germany | 5/417 |
| 2568756 | 2/1986 | France | 190/2 |

*Primary Examiner*—Alexander Grosz
*Attorney, Agent, or Firm*—John L. James

[57] ABSTRACT

A picnic blanket and carrying pouch are provided. The blanket is composed of top and bottom layers of material sewn together along several horizontal and vertical seams to define left, center and right panels, upper and lower fastener portions, and a pocket portion. Fasteners are attached to the bottom layer of material with upper fasteners attached to the center panel in the upper fastener portion, and lower fasteners attached to the right panel in the lower fastener portion. a slit in the bottom piece of material is the entrance to a pocket that receives a dowel. The left panel of the blanket folds over the center panel, and the right panel folds over both the left and center panels. The blanket is rolled from the top toward the bottom to expose the fasteners to one another. The rolled and fastened blanket is inserted into the pouch. The rigid dowell facilitates insertion of the blanket into the pouch.

4 Claims, 1 Drawing Sheet

Fig_1
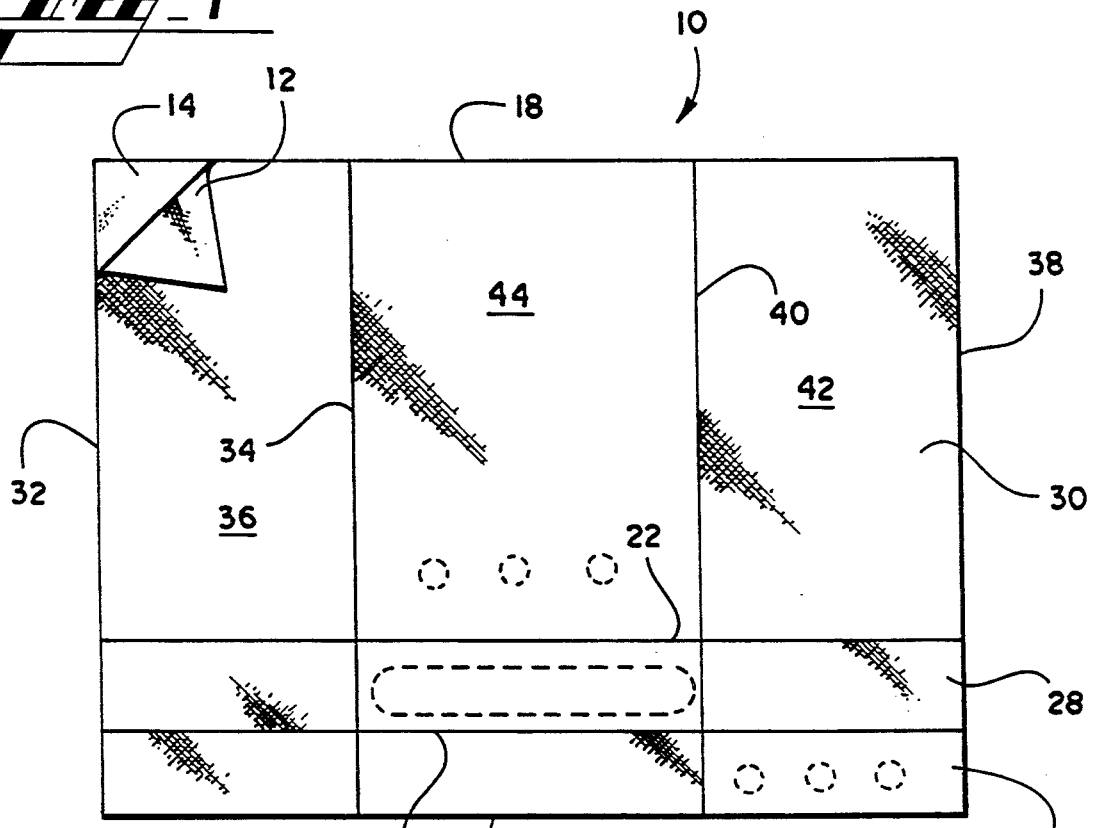
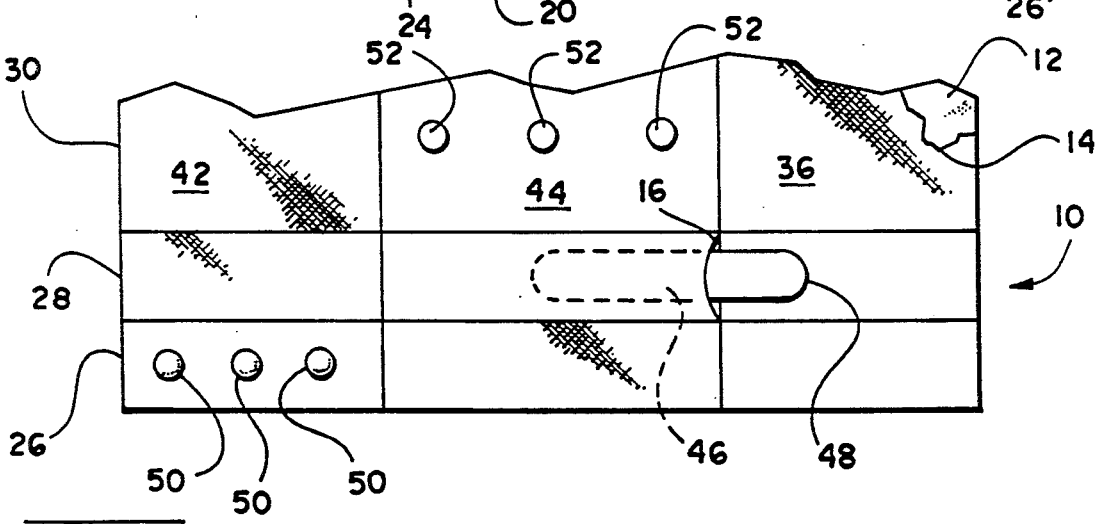
Fig_2
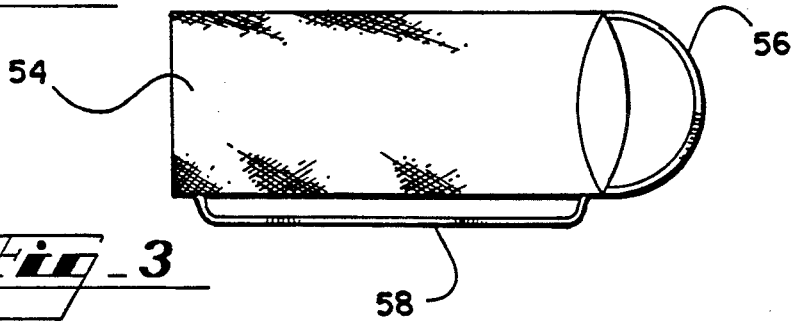
Fig_3

PICNIC BLANKET AND STORAGE POUCH

TECHNICAL FIELD

This invention generally relates to a blanket and carrying pouch for the blanket, and, more particularly, to a picnic blanket that is foldable to fit into the carrying pouch.

BACKGROUND OF THE INVENTION

Camping, hiking and picnicking are outdoor activities enjoyed by many people. A picnic can be a very enjoyable activity when the items and utensils required are simple and easy to carry and use. A picnic basket is commonly used to carry food and other picnic items to the picnic site. A blanket is needed to spread on the ground to sit upon to insulate and isolate the picnicker from the ground. A blanket also serves as a barrier to unwanted pests, such as ants.

One problem with blankets used for picnics is that they tend to be bulky and are difficult to carry and store. This can be quite a problem when embarking upon a picnic because the picnic basket is usually filled with food, and there is little space inside for the blanket. Carrying the blanket to the picnic site is a nuisance. On the return trip, the basket is lighter, but the bulk of the blanket is usually too great to fit inside the picnic basket. Accordingly, it will be appreciated that it would be highly desirable to have a picnic blanket that is not bulky and is easy to carry.

Another problem with picnic blankets is that the bulk of the blanket is partially dependent upon the method used to fold the blanket for transport. Accordingly, it will be appreciated that it would be highly desirable to have a blanket with a predetermined folding pattern so that it becomes a neat, compact bundle for transporting in a carrying pouch.

SUMMARY OF THE INVENTION

The present invention is directed to overcoming one or more of the problems set forth above. Briefly summarized, according to one aspect of the present invention, a picnic blanket has first and second pieces of cloth sewn together along their edges with additonal seams running parallel to their left and right side edges. The seams define left, center and right panels, and also define a pocket between the first and second pieces of material. A slit is formed in the second piece of material and is the entrance to the pocket.

Fasteners are connected to the second piece of material in the center panel and in the right panel. When the blanket is folded the left panel is folded over the center panel, and the right panel is folded over both the left and center panels, and is rolled from the top edge toward the bottom edge. When so rolled, the fasteners are engageable with one another to secure the blanket in the rolled or folded condition. When so rolled, the pocket is accessible for placing a rigid dowel therein to facilitate stuffing the rolled blanket into a carrying pouch. The carrying pouch may have a handle connected to its top end for carrying the pouch, or a shoulder strap connected thereto for carrying the pouch and blanket on the shoulder.

It is an object of the present invention to provide a blanket for picnic used that is easy to use and transport.

Another object of the invention is to provide a picnic blanket that is not bulky and is easily folded for storage.

Another object of the invention is to provide a carrying pouch for the blanket that is easy to carry.

Still another object of the invention is to provide a picnic blanket and storage pouch so that the blanket is easily inserted into the pouch when folded.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 1 is a plan view of a preferred embodiment of a picnic blanket constructed in accordance with the present invention.

FIG. 2 is a diagrammatic rear view of the blanket of FIG. 1.

FIG. 3 is plan view of a preferred embodiment of a storage and carrying pouch made in accordance with the present invention.

DETAILED DESCRIPTION OF THE PREFERRED EMBODIMENTS

Referring to FIGS. 1 and 2, a picnic blanket 10 is constructed of a first piece of cloth 12 that left and right edges spanning the length of the cloth 12, and top and bottom edges spanning the width of the cloth 12. The first piece of cloth 12 forms the top surface of the blanket 10, and may be constructed of a quilted material to add a small amount of cushioning to the blanket 10. A second piece of material 14 also has left and right edges spanning the length of the cloth 14, and top and bottom edges spanning the width of the second piece of cloth 14. The second piece of the cloth 14 may be constructed of the same material as the first piece of material 12, but it is preferred that the second piece of cloth 14, which is the bottom of the blanket 10, be constructed of a moisture resistant material. The second piece of cloth 14 has a slit 16 therein. The top and bottom pieces of cloth 12, 14 have the same length and width dimensions.

The top and bottom pieces of cloth 12, 14 are connected by a top seam 18 that runs along the top edges of the cloths 12, 14. A first bottom seam 20 connects the top and bottom pieces of cloth 12, 14 along their bottom edges. A second bottom seam 22 connects the top and bottom pieces of cloth 12, 14, and runs parallel to the first bottom seam 20, but is spaced from the first bottom seam 20 a preselected distance. Preferably, a third bottom seam 24 also connects the top and bottom cloths 12, 14, and is positioned parallel to and intermediate the first and second bottom seams 20, 22. The third bottom seam 24 divides the lower portion of the blanket 10 into a lower fastener portion 26 that exists between the first and third bottom seams 20, 24, and a pocket portion 28 that exists between the second and third bottom seams 22, 24. An upper fastener portion 30 exists between the second bottom seam 22 and the top seam 18.

A first left side seam 32 extends along the left edges of the cloths 12, 14 between the top seam 18 and first bottom seam 20. A second left side seam 34 connects the top and bottom cloths 12, 14 and extends between the top seam 18 and the first bottom seam 20, and defines a left panel 36 that extends between the first and second left side seams 32, 34.

A first right side seam 38 connects the top and bottom cloths 12, 14 and extends between the top seam 18 and first bottom seam 20. A second right side seam 40 also connects the top and bottom cloths 12, 14 and extends between the top seam 18 and the first bottom seam 20, and defines a right panel 42 that extends between the first and second right side seams 38, 40.

A center panel 44 is positioned between the left and right panels 36, 42. By this construction, a blanket is formed that is divided into left, right and center panels 36, 42, 44, and upper and lower fastener portions 30, 26 and an pocket portion 28.

A pocket 46 is formed between the first and second pieces of material 12, 14, and is bounded by the first and second bottom seams 20, 22, or more preferably, the second and third bottom seams 22, 24, and the second left and right side seams 34, 40. The slit 16 is the entrance to the pocket 46. As illustrated, the pocket 46 is in the center panel 44 and the pocket portion 28 of the blanket 10. The pocket 46 has a size sufficient for receiving a rigid dowel 48 therein.

In the center panel 44, the bottom cloth 14 and lower fastener portion 26, there are fastener means 50, such as one portion of a metal snap or a hook and loop type fastener, such as the one sold under the trademark of Velcro. In the center panel 44, bottom cloth 14 and upper fastener portion 30, there are second fastener means 52, such as a second portion of a metal snap or VELCRO fastener.

Referring to FIG. 3, a carrying and storage pouch 54 is provided for the blanket 10. The pouch 54 has a simple, sleeve-like construction with a carrying handle 56 attached to its open, top end, and a shoulder strap 58 attached along its side so that the pouch may be carried in the hand by the handle 56 or on the shoulder by the shoulder strap 58. The pouch 54 may be constructed of a single piece of material that is folded over with its bottom and sides sewn together leaving its top open for insertion of the picnic blanket 10.

During use, the blanket 10 is laid out as illustrated in FIG. 1 on the ground or other convenient surface. When being used by only one person the blanket 10 can be steadied against movement by the wind by inserting the dowel 48 into the pocket 46. Alternatively, an iron pin may be inserted into the pocket 46 in lieu of the plastic or wooden dowel 48 to provide a greater mass to hold down the blanket against the force of the wind.

When the picnic is over, the left panel 36 is folded along the second left seam 34 so that its overlays the center panel 44. Next, the right panel 42 is folded along the second fright seam 40 so that it overlays both the left and center panels 36, 44. Then the blanket 10 is rolled from the top seam 18 toward the first bottom seam 20. In so rolling the blanket 10, the first and second fasteners means 50, 52 will be rolled into a position where they can be connected to secure the blanket 10 in the rolled condition. The pocket 46 is visible when the blanket 10 is rolled and fastened using the fasteners 50, 52. The dowel 48 is inserted into the pocket 46 to add rigidity to the rolled blanket 10 for easy insertion into the carrying pouch 54.

It will be now appreciated that there has been presented a picnic blanket 10 that is easy to use and which folds and rolls into an easily stored or carried package. When rolled and stored in the pouch 54, the blanket 10 may be carried inside a picnic basket or will easily fit between the basket handles so that it is easy to transport. The picnic blanket has a predetermined folding pattern so that it becomes a neat, compact bundle for transporting in the carrying pouch. It is not bulky and is easy to transport.

While the invention has been described with particular reference to a preferred embodiment, it will be understood by those skilled in the art that various changes may be made and equivalents may be substituted for elements of the preferred embodiment without departing from invention. For example, the pocket may extend across the width of the blanket instead of a single panel. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled the art. For example, the blanket may be equipped with anchor rings on its corners to further stabilize the blanket in windy conditions, and the anchors may be stored in the pocket. It is accordingly intended that the claims shall cover all such modifications and applications as do not depart from the true spirit and scope of the invention.

I claim:

1. A picnic blanket, comprising:

a first piece of cloth having a left edge and a right edge spanning the length of said piece of cloth, and a top edge and a bottom edge spanning the width of said piece of cloth;

a second piece of cloth having a slit therein, a left edge and a right edge spanning the length of said piece of cloth, and a top edge and a bottom edge spanning the width of said piece of cloth, said first and second pieces of cloth having the same dimensions in length and width;

a top seam connecting said first and second pieces of cloth along said top edges;

a first bottom seam connecting said first and second pieces of cloth along said bottom edges;

a second bottom seam connecting said first and second pieces of cloth and being positioned parallel to said first bottom seam and spaced therefrom a preselected distance;

a first left side seam extending between said top seam and said second bottom seam;

a second left side seam extending between said top seam and said first bottom seam and defining a left panel between said first and second left side seams a first right side seam extending between said top seam and said second bottom seam;

a second right side seam extending between said top seam and said first bottom seam and defining a right panel between said first and second right side seams;

a center panel positioned between said left and right panels;

a pocket formed between said first and second pieces of material and defined by said first and second bottom seams and said second left and right side seams, said slit being an entrance to said pocket;

a first fastening means attached to said second piece of material in said center panel; and a second fastening means attached to said second piece of material in said right panel.

2. A picnic blanket, according to claim 1, including:

a first fastening means attached to said second piece of material in said center panel; and a second fastening means attached to said second piece of material in said right panel.

3. A picnic blanket, according to claim 1, wherein said first and second fastening means are engageable with one another when said left panel is folded over said center panel and said right panel is folded over both said left and center panels, and said blanket is rolled from said top edge toward said bottom edge.

4. A picnic blanket, according to claim 1, including a carrying pouch.

* * * * *